US005333530A

United States Patent [19]

Simon et al.

[11] Patent Number: 5,333,530

[45] Date of Patent: Aug. 2, 1994

[54] SYSTEM FOR LOADING A ROUND INTO A PIVOTING CHAMBER OF A GUN

[75] Inventors: Georges Simon, Saint-Germain-Du-Puy; Michel Baubois, Bourges, both of France

[73] Assignee: Giat Industries, Versailles, France

[21] Appl. No.: 64,956

[22] Filed: May 20, 1993

[30] Foreign Application Priority Data

May 21, 1992 [FR] France ..... 92 06198

[51] Int. Cl.[5] ..... F41A 9/45

[52] U.S. Cl. ..... 89/13.1; 89/33.03; 89/33.05; 89/47

[58] Field of Search ..... 42/9, 39.5; 89/9, 13.1, 89/33.03, 33.05, 47, 155, 156

[56] References Cited

U.S. PATENT DOCUMENTS 2,865,254 12/1958 Aldrin ..... 89/45

3,899,954 8/1975 Jayne et al. ..... 89/33.4

4,827,829 5/1989 Stoner ..... 89/43.01

FOREIGN PATENT DOCUMENTS 004581 10/1979 European Pat. Off. .

3427875 4/1992 Fed. Rep. of Germany .

*Primary Examiner*—Stephen C. Bentley

*Attorney, Agent, or Firm*—Bell, Seltzer, Park & Gibson

[57] ABSTRACT

The invention relates to a loading system for loading a round into a pivoting chamber of a gun. The system comprises a control device for controlling pivoting of the chamber, a feed device for feeding rounds and constituted by a feed station in alignment with the trunnion axis of the gun, a loading station in alignment with the axis of the chamber when it is in its loading position, and means for causing the round to pivot from the feed station to the loading station, and to load it into the chamber.

20 Claims, 6 Drawing Sheets

SYSTEM FOR LOADING A ROUND INTO A PIVOTING CHAMBER OF A GUN

FIELD OF THE INVENTION

The present invention relates to a system for loading a round into a pivoting chamber of a gun, in particular a medium caliber gun comprising an oscillating mass trunnioned about a horizontal axis in a support frame and a recoil mass including, in particular, a barrel, the pivoting chamber, and a sleeve in which the chamber pivots in reciprocating manner between a first, "firing" position and a second, "loading" position, said two positions being angularly offset from each other through an angle a lying in the range 0° to 90°, and of the type comprising a chamber pivoting control device, a round feed device, and a loading device for loading a new round into the chamber when the chamber is in its loading position.

Loading systems of the above-mentioned type are known, in particular from documents U.S. Pat. No. 4,827,829 and EP-0 004 581.

In document U.S. Pat. No. 4,827,829, the chamber pivots in a vertical plane about a horizontal axis that is in alignment with the trunnion axis of the gun. Whatever the elevation angle of the gun, the chamber in the loading position is always in alignment with a vertical axis and a new round is loaded through the bottom opening of the chamber. In other words, the pivot angle of the chamber varies as a function of the elevation angle of the gun, and it is always equal to the complementary angle of the elevation angle. The devices for feeding and loading a round into the chamber (not described in detail in that document) are secured to a stationary support, and it is merely specified that they do not include a flexible coupling device between the loading device and the breech block of the gun to compensate for changes in the elevation angle of the gun between two round-loading positions. It should be observed that in that document a round can be loaded into the chamber only after the gun has returned to the battery position, which reduces firing rates.

In document EP-0 004 581, the chamber pivots through 360° in steps of 90°. In other words, after pivoting through 90°, the chamber has passed from a firing position to a loading position or vice versa. The chamber pivots in a vertical plane about an axis parallel to the trunnion axis of the gun. The rounds are stored in a magazine in the form of a bar situated above the chamber. The rounds are disposed vertically and they are loaded one by one by means of a lever when the chamber is in one of its two loading positions which are aligned on a vertical axis perpendicular to the barrel axis. The magazine is linked in translation to the chamber and a round is loaded during the return phase of the recoil motion of the gun. In general, the system described in that document takes up a large amount of volume which is incompatible for use with a medium caliber gun mounted, in particular, on an armored vehicle. In addition, the displacement of the loading device during the recoil motion of the gun is detrimental to proper operation thereof.

OBJECT AND BRIEF SUMMARY OF THE INVENTION

The object of the invention is to design a feed system in particular for a medium caliber gun that is capable of mitigating the drawbacks of the systems mentioned above while also providing other advantages.

To this end, the invention provides a feed system of the above-specified type, wherein the feed device is secured to the recoil mass of the gun and comprises a feed station in which the new round is aligned on an axis substantially parallel to the trunnion axis of the gun, a loading station secured to the recoil mass of the gun and in which the new round is aligned on the axis of the chamber when the chamber is in its loading position, said two stations being offset angularly relative to each other by an angle b which is substantially complementary to the pivot angle a of the chamber, and means for transferring the round by pivoting from The feed station to the loading station.

in general, the gun is trunnion-mounted on a support frame for the gun, and the chamber pivots through an angle that is fixed and close to 30° about an axis perpendicular both to the trunnion axis of the gun and to the axis of the barrel.

In an embodiment of the invention, the round installed in the feed station is disposed parallel to the trunnion axis of the gun, and it is preferably in alignment with said axis.

According to another feature of the invention, the pivot means for transferring the round from the feed station to the loading station comprise drive means that bear against the round.

In an embodiment outlined below, said means for transferring rounds comprise an endless chain wound over a plurality of sprockets, plus at least one first finger secured to the chain and coming into contact with the round for causing it to pivot. The chain passes round at least three sprockets which delimit a triangle having a first side that is parallel to the trunnion axis of the gun and having a second side that is parallel to the axis of the chamber when in its second position, the first finger secured to the chain moving along the three sides of the triangle, it being understood that while the finger is moving along the third side of the triangle it bears against the body of the round to pivot it between the feed station and the loading station, and while it is moving along the second side of the triangle, it bears against the face of the round to push it between guide ramps into the chamber.

Thus, in this embodiment, the means for transferring the round from the feed station to the loading station also form the device for loading the round into the chamber.

Since the loading system of the invention is secured to the recoil mass of the gun, and given that a new round is installed in the feed station before the gun begins its recoil motion due to firing a round loaded in the chamber, retaining means are provided according to another disposition of the invention for bearing against the new round to hold it in position in the feed station during the recoil motion of the gun.

In an embodiment, said retaining means is constituted by the first drive finger carried by the chain of the above-specified transfer means, and by a second finger likewise secured to the chain, with the distance between the two fingers being less than the length of a round. In a variant, the retaining means may be constituted by a fixed abutment.

In general terms, the device for controlling pivoting of the chamber comprises a cam mounted to rotate about an axis perpendicular to the trunnion axis of the gun and connected firstly to the chamber by means of a first link mechanism for transforming the rotary motion of the cam into reciprocating pivoting motion of the chamber, and secondly to a drive member such as a motor and gear box unit, via a second link mechanism for causing it to rotate.

In an embodiment described below, the cam is constituted by a disk, and the first link mechanism which transforms the rotary motion of the cam into reciprocating pivoting motion of the chamber is constituted by a groove situated on the bottom face of the disk and by a roller mounted free to rotate at the end of an arm which is secured to the pivot axis of the chamber, and which is received in the groove to follow the cam profile which has four successive sectors that correspond successively to the chamber being held in the open or loading position, to the chamber being pivoted to the firing position, to the chamber being held in the firing position, and to the chamber being pivoted in the opposite direction to return to the open or loading position.

According to another disposition of the invention, the means for transferring a round from the feed station to the loading station may be actuated by the pivoting control cam of the chamber by means of a set of teeth carried by the disk of the cam and meshing with an intermediate gear wheel constrained to rotate with one of the driving sprockets of the chain of the transfer means.

According to yet another disposition of the invention, a locking device is provided which is controlled by the cam and which has the function of locking a round in the chamber, said device comprising a retractable abutment which is capable of projecting through the outlet opening of the chamber while also enabling an empty cartridge case to be ejected from the chamber by the round which is being loaded.

The invention relates mainly to automatic guns that use telescoped ammunition, i.e. cylindrical rounds where the projectile does not project from the cartridge case and which are shorter than conventional rounds, with such guns being designed, in particular, for mounting on infantry combat vehicles.

BRIEF DESCRIPTION OF THE DRAWINGS

Other advantages, features, and details of the invention appear from the following explanatory description made with reference to the accompanying drawings given purely by way of example and in which.

MORE DETAILED DESCRIPTION

Figure 1:
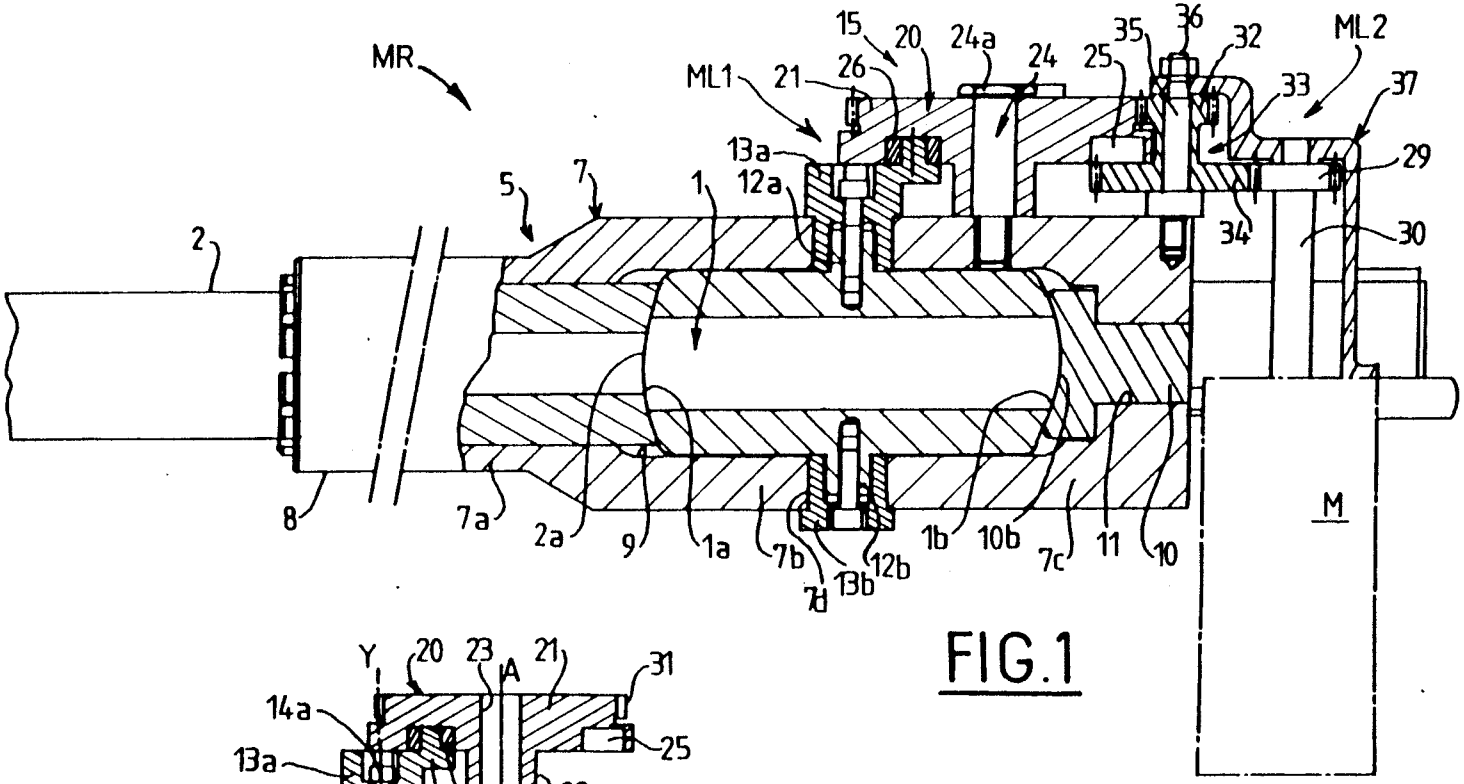
FIG. 1 is a fragmentary longitudinal section on the axis of the gun barrel, showing the loading system of the invention, and in particular the device for controlling pivoting of the chamber.
Figure 1A:
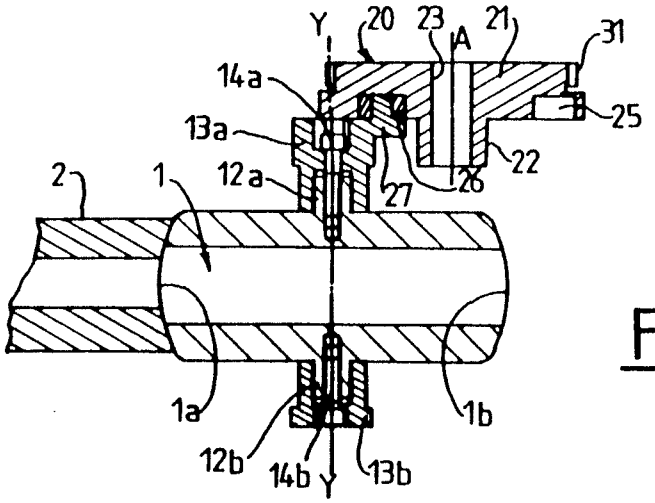
FIG. 1*a* is a view similar to FIG. 1, but showing only a portion of The chamber pivoting control device.
Figure 2:
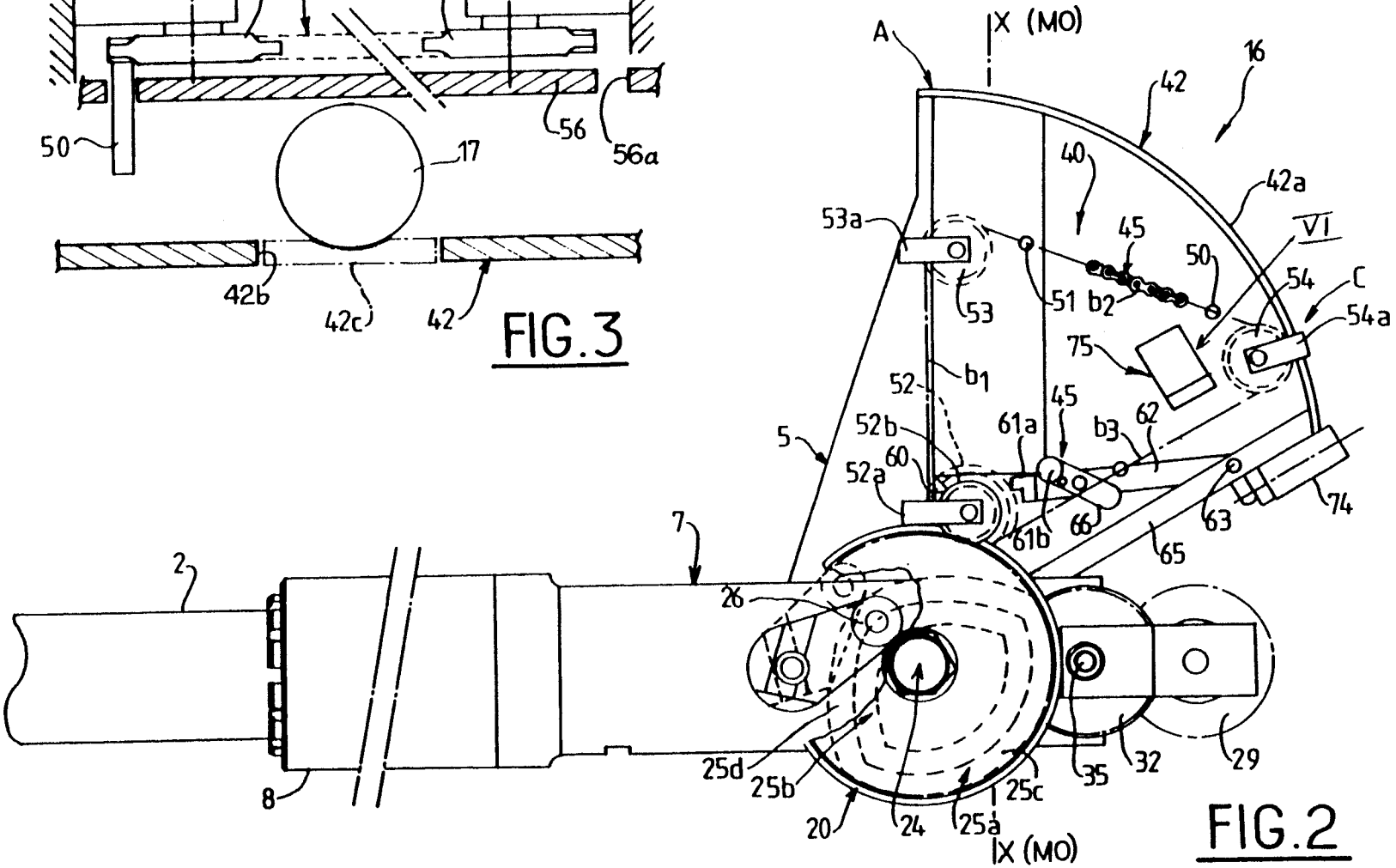
FIG. 2 is a fragmentary plan view of the loading system of the invention, showing, in particular, the device for feeding the loading system, i.e. a feeding station and a loading station.

A system of the invention for loading a round into a, pivoting chamber 1 of a gun is shown in FIGS. 1, 1*a*, and 2.

In general, the gun comprises an oscillating mass MO trunnioned about an axis X—X that is substantially horizontal and that is supported by a support frame (not shown), together with a recoil mass MR that includes, in particular, the chamber 1, the barrel 2 of the gun, and a support means 5. The recoil mass MR forms a portion of the oscillating mass MO but is capable of moving relative thereto while the gun is recoiling after firing a round. The barrel 2 has its rear end inserted in a sleeve 7 of said support means 5 and is screwed in place by a threaded ring 8.

The chamber 1 comprises an elongate hollow cylindrical body whose two end surfaces 1*a* and 1*b* are both convexly spherical in shape. The chamber 1 is received in a cavity 9 formed in the central portion 7*b* of the sleeve 7, said cavity 9 opening out laterally outside the sleeve 7 to enable the chamber 1 to move angularly.

A striker system 10 of conventional design is engaged and fixed in the central opening 11 defined at the end of the rear portion 7*c* of the sleeve 7. The rear end face 2*a* of the barrel 2 and the front end surface 10*b* of the striker system 10 are spherically concave in shade, being complementary to the end surfaces 1*a* and 1*b* respectively of the chamber 1.

At halfway along its length, the chamber 1 has two diametrically opposite outwardly directed projections 12*a* and 12*b* which are freely engaged in two lateral openings 7*d* of the sleeve 7. The two projections 12*a* and 12*b* are in alignment on an axis Y—Y or pivot axis of the chamber 1 which is perpendicular to the trunnion axis X—X of the gun. Two stub axles 13*a* and 13*b* (FIG. 1*a*) are respectively constrained to rotate with the two projections 12*a* and 12*b*, and they are fixed axially by means of respective screws 14*a* and 14*b* that are in alignment on the pivot axis Y—Y of the chamber 1.

The loading system of the invention comprises, in particular, a pivoting control device 15 for the chamber 1, and a feed device 16 for bringing a round 17 from a feed station to a loading station for loading into the chamber 1 when it is in its loading position. These various devices are described in succession below.

In the example described herein (FIGS. 1 and 1*a*), the control device 15 which causes the chamber 1 to pivot comprises a cam 20 in the form of a disk 21 having a central projection 22 on one face (a lower face) and a through central opening 23. The cam 20 is mounted to rotate about an axis A that is perpendicular to the trunnion axis X—X of the gun. The axis A is embodied by the cylindrical shank of a screw 24 that passes freely through the central opening 23 of the disk 21. At one end, the screw 24 has its head 24*a* bearing against the top surface of the disk 21 while its threaded opposite end is screwed into the wall of the sleeve 7, with the end surface of the projection 22 on the disk 21 bearing against the sleeve 7.

In general, the cam 20 is connected firstly to the chamber 1 via a first mechanical link device ML1 which transforms the rotary motion of the cam 20 into reciprocating pivoting motion of the chamber 1, and secondly to a drive member such as a motor and gear box unit M via a second mechanical link device ML2 which serves to rotate the cam 20 from the rotary motion of the outlet shaft of the motor M.

With reference to FIGS. 1, 1*a*, and 2, the first mechanical link device ML1 comprises a groove 25 situated in the lower face of the disk 21 of the cam 20 and associated with a roller 26 that is received in the groove 25. The roller 26 is mounted freely to rotate at the end of a crank 27 that extends the stub axles 13*a* of the chamber 1 laterally, said axle and crank constituting a driving crank assembly. The groove 25 is subdivided into four successive sectors 25*a*, 25*b*, 25*c*, and 25*d*. The sector 25*a* corresponds to the chamber 1 in the open or loading position, and it is centered on the axis of rotation of the cam 20. When the roller 26 moves along said sector 25*a* of the groove 25, the chamber 1 remains stationary in the loading position. When the roller 26 moves along the sector 25*b* following the sector 25*a* in the direction of rotation of the cam 20, it causes the chamber 1 to pivot towards its firing position. When the roller 26 moves along the following sector 25*c* which is centered on the axis of rotation of the cam 20, the chamber 1 remains stationary in its firing position. Finally, when the toiler 26 moves along the last sector 25*d*, it pivots the chamber 1 back to its loading position.

Thus, during one full turn of the cam 20, the toiler 26 runs successively along the four sectors of the groove 25, thereby causing the chamber to perform reciprocating pivoting motion through an angle of about 30° in the present example.

The second mechanical link device ML2 comprises a gear wheel 29 constrained to rotate with the outlet shaft 30 of the motor M. The peripheral lateral surface of the disk 21 of the cam 20 has a set of teeth 31 meshing with a first gear 32 of an intermediate double pinion 33 whose other gear 34 meshes with the gear wheel 29. The intermediate pinion 33 is rotatably mounted on a shaft 35 having one end received in the sleeve 7 and having its opposite end retained by a screw 36 whose head bears against a bracket 37 forming part of the sleeve 5.

With reference to FIG. 2, the feed device 16 comprises a feed station A for receiving a round 17, a loading station C from which the round 17 is loaded into the chamber 1, and means 40 which serve both to transfer the round 17 from the feed station A to the loading station C, and to load the round into the chamber 1.

In the example described herein, the feed station A and the loading station C are angularly offset from each other by an angle that is complementary to the pivot angle of the chamber 1, i.e. by an angle close to 60° when the chamber 1 pivots through an angle close to 30°. When a round 17 is in position in the feed station A, it is in alignment with the trunnion axis X—X of the gun barrel 2 (in a preferred embodiment of the invention), whereas when it is in place in the loading station C, it is in alignment with the axis of the chamber 1 when the chamber is in its loading position.

The feed station A and the loading station C are provided on a plate 42 which is secured to the recoil mass MR of the gun. The plate 42 is offset laterally relative to the axis of the barrel 2 and its overall shape is that of a circular sector whose radius is not less than the length of a round 17. When the elevation angle of the gun is close to 0°, the plate 42 is situated in a plane that is substantially horizontal.

The feed station A and the loading station C are situated adjacent to two respective rectilinear edges of the circular sector of the plate 42. One of these edges of the plate 42 extends substantially parallel to the trunnion axis X—X of the gun, with the feed station A being adjacent to said edge, whereas the other edge of the plate 42 extends substantially parallel to the loading axis of the chamber 1, with the loading station C being adjacent to said other edge. The arcuate edge of the plate 42 has a rim 42*a* for guiding the round as it is being transferred from the feed station A to the loading station C.

Figure 3:
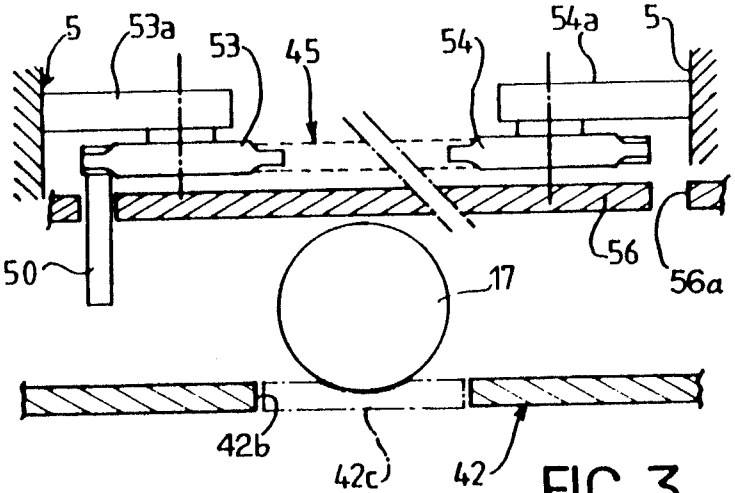
FIG. 3 is a fragmentary section view through the feed station of FIG. 2.

In the example descried herein with reference to FIGS. 2 and 3, the means 40 which transfer a round 17 from the feed station A to the loading station C are constituted by an endless chain 45. This chain 45 carries a drive finger 50 and a retaining finger 51 that extends perpendicularly to the plate of the chain 45, and to the same side thereof. The chain 45 is wound round three sprockets 52, 53, 54 having parallel axes that are disposed in a triangle and that are rotatably supported on the plate 42.

Rotation of the cam 20 that causes the chamber 1 to pivot may also serve to drive the chain 45 via a gear wheel 52*b* which is coaxial with and secured to the sprocket 52, and which meshes with the set of teeth 31 on the cam 20. The side of the triangle defined overall by the two sprockets 52 and 53 is substantially parallel to the round 17 when it is put in place in the feed station A. The side of the triangle defined overall by the sprockets 52 and 54 is substantially parallel to the round 17 when it is in place in the loading station C.

The triangle defined in this way by the three sprockets 52, 53, and 54 subdivides the chain 45 into three lengths b1 (between the sprockets 52 and 53), b2 (between the sprockets 53 and 54), and b3 (between the sprockets 52 and 54).

The sprockets 52, 53, and 54 are supported by three brackets 52*a*, 53*a*, and 54*a*, respectively. With reference more particularly to FIG. 3, an intermediate plate 56 is provided between the sprockets 52, 53, and 54 and the plate 42, with the intermediate plate 56 including a slot 56*a* corresponding to the triangle formed by the chain 45 to allow the fingers 50 and 51 to pass freely. The gap between the two plates 42 and 56 is slightly greater than the width of a round 17. The plate 42 includes an opening 42*b* for bringing a round 17 to the feed station A by means of a conveyor 42*c*, e.g. as shown in chain-dotted lines.

Figure 4:
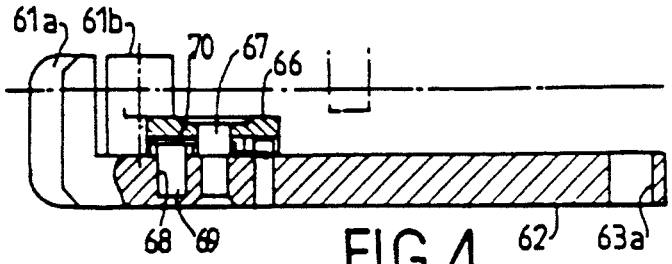
FIG. 4 is a fragmentary section view of a retractable abutment situated in the loading station of the feed device.
Figure 5:
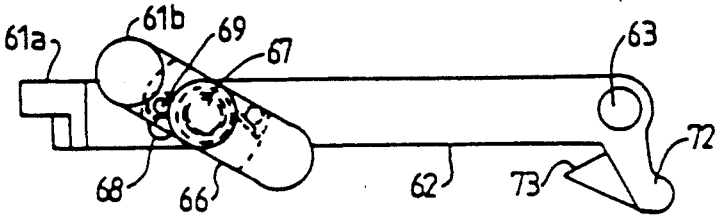
FIG. 5 is a plan view of FIG. 4.

With reference to FIGS. 2, 4, and 5, when the round 17 is in place in the feed station A, its front end has one side bearing against a fixed abutment 60 and its other side bearing against a pair of abutments 61*a* and 61*b*, where abutment 61*b* is retractable. The abutment 61*a* is constituted by the end of a lever 62 whose other end is hinged to pivot about an axis 63 carried by a stationary wall 65 and which passes through a hole 63*a* in the lever 62. This wall 65 extends parallel to the axis of the chamber 1 when the chamber is in its loading position, and it serves to guide the round 17 as it enters the chamber 1.

The abutment 61*b* is formed by the end of a lever 66 which is pivoted substantially in the middle about an axis 67 carried by the lever 62 in the vicinity of the end thereof that forms the abutment 61*a*. The lever 62 includes an oblong groove 68 in which a pin 69 secured to the lever 66 moves, which pin extends parallel to the hinge pin 67 of said lever. A spiral spring 70 is mounted around the hinge pin 67 having one of its ends fixed to the pin 69 and having its other end fixed to the lever 62. The spring 70 urges the pin 69 permanently towards one end of the oblong groove 68, with the lever 66 then taking up a position that is angularly offset relative to the lever 62, as shown in FIG. 5.

Adjacent to its pivot pin 63, the lever 62 includes a lateral extension 72 which carries an abutment 73 for coming into contact with the fixed wall 65 for limiting the pivoting motion of the lever 62. A spring 74 (shown in FIG. 2) acts continuously on said lateral extension 72 of the lever 62 so that the abutment 73 is in contact with the fixed wall 65, i.e. so that the lever 62 takes up a position corresponding to a maximum pivot angle relative to the wall 65, as can be seen in FIG. 2.

Figure 6:
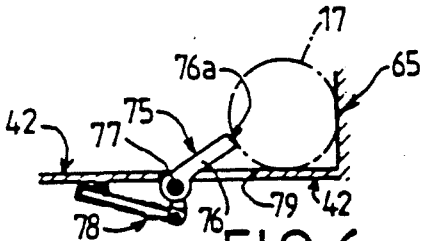
FIG. 6 is a fragmentary section view showing a detail marked by arrow VI in FIG. 2.

An additional guide means 75 is provided in the loading station C for guiding the round 17 as it penetrates into the chamber 1. This guide means faces the guide wall 65 and is constituted, as shown in FIG. 6, by a flap 76 having one longitudinal side pivoted about an axis 77. The flap 76 is continuously urged by a spring device 78 so as to project through an opening 79 provided in the plate 42. The flap 76 then takes up a position that is inclined at an angle of about 45° relative to the plane of the plate 42, and its longitudinal side 76*a*, opposite to its side hinged about the axis 77, extends parallel to the guide wall 65.

Figure 7:
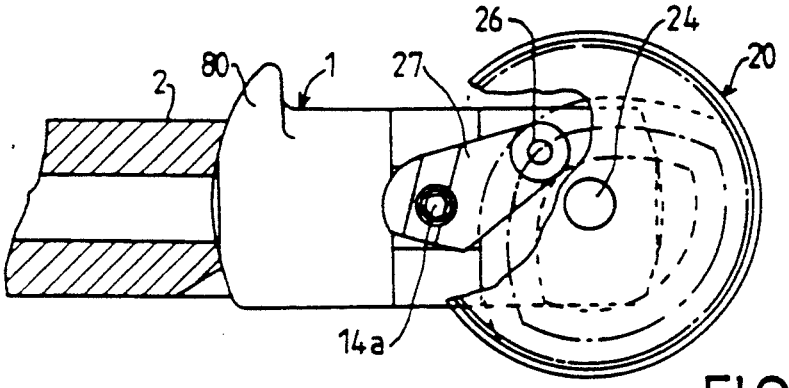
FIGS. 7 and 8 are fragmentary diagrammatic views for showing the two positions of the chamber, respectively the firing position and the loading position.
Figure 8:
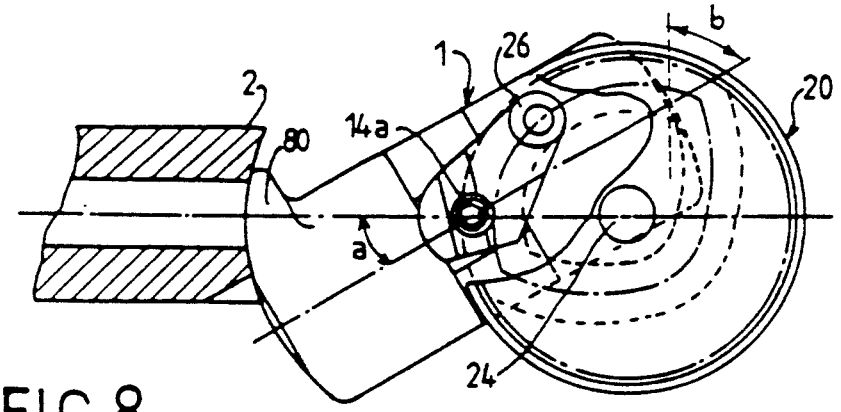

With reference to FIGS. 7 and 8, it can be seen that the chamber 1 includes, towards its end adjacent to the inlet to the barrel 2, a lateral projection 80 whose function is to close the inlet to the barrel 2 while the chamber 1 is in its loading position, as can be seen clearly in FIG. 8, thereby serving firstly to avoid any foreign body penetrating therein, and secondly to provide sealing against combustion gases.

Figure 10:
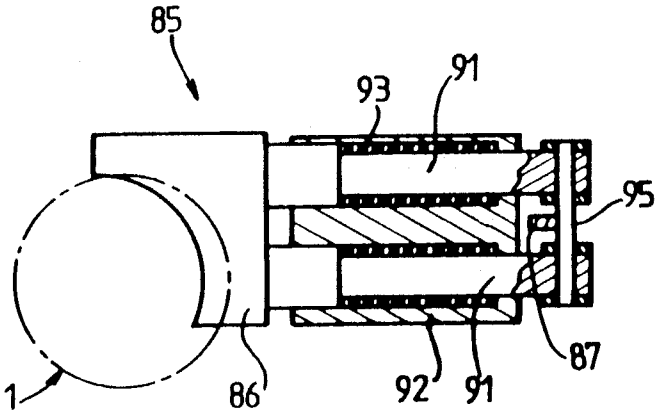
FIGS. 10 and 10*a* are views similar to FIGS. 9 and 9*a*, with the abutment shown in its lowered position.
Figure 9:
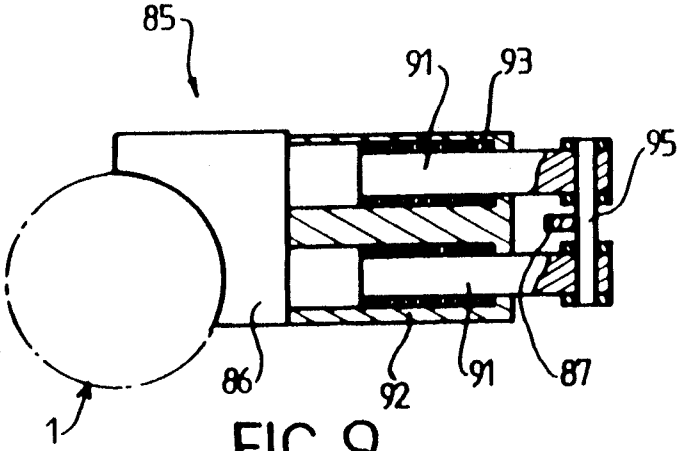
FIGS. 9 and 9*a* are diagrammatic section views showing a device constituting a retractable abutment for holding a round inside the chamber, with the abutment being shown in its raised position.

Finally, with reference to FIGS. 9 and 10, there can be seen a device 85 that enables a round 17 to be locked in place once loaded in the chamber 1. This device 85 comprises a retractable abutment 86 controlled by the end of a lever 87 mounted to pivot about an axis 88 supported by the sleeve 5, and having its opposite end supporting a roller 89 which bears against a ramp 90 provided on the peripheral surface of the control cam 20.

The abutment 86 is supported by two parallel rods 91 that pass through a stationary support piece 92 and each of which co-operates with a respective spring 93. The springs 93 urge the abutment 86 so that a portion thereof projects through the outlet opening of the chamber 1 when the chamber is in its loading position. The free ends of the two rods 91 are connected together by a pin 95 against which the lever 87 bears to raise the abutment 86.

The operation of the system for loading a round 17 into the chamber 1 is now descried with reference more particularly to FIGS. 9 to 12.

Figure 11:
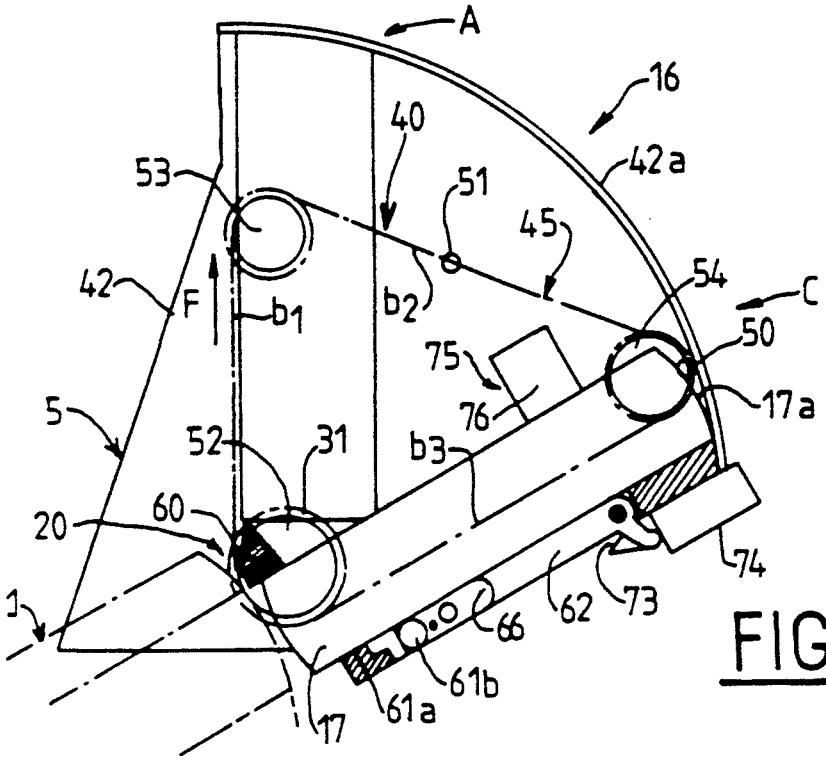
FIGS. 11 to 14 are diagrammatic views showing successive stages in loading a round into the chamber.

The loading system is initially considered in the position shown in FIG. 11 where a round 17 is in place in the loading station C and is in alignment with the axis of the chamber 1 since the chamber is then in its loading position after pivoting through an angle of about 30° relative to the axis of the barrel 2. The roller 26 is then situated at the entrance to the sector 25*a* of the groove 25 in the cam 20. The finger 50 of the pivoting and loading means 40 is then situated in the vicinity of the base 17*a* of the round 17.

The motor M is actuated to rotate the cam 20 and to drive the chain 45 that supports the finger 50. More precisely, the teeth 31 carried by the disk 21 of the cam 20 rotate the driving sprocket 52 of the chain 45 via the gear wheel 52*b* in the example described. By driving the chain 45 in the direction indicated by arrow F, the finger 50 is caused to move along the length b3 of the chain. The finger 50 comes in contact with the base 17*a* of the round 17, thereby thrusting it into the chamber 1. As it moves, the round 17 is guided laterally by the fixed wall 65 on one side and by the abutment 60 and the flap 76 on the other side. It should be observed that the lever 62 which carries the abutments 61*a* and 61*b* is then superposed with the stationary guide wall 65, with the abutments then performing no function.

Figure 12:
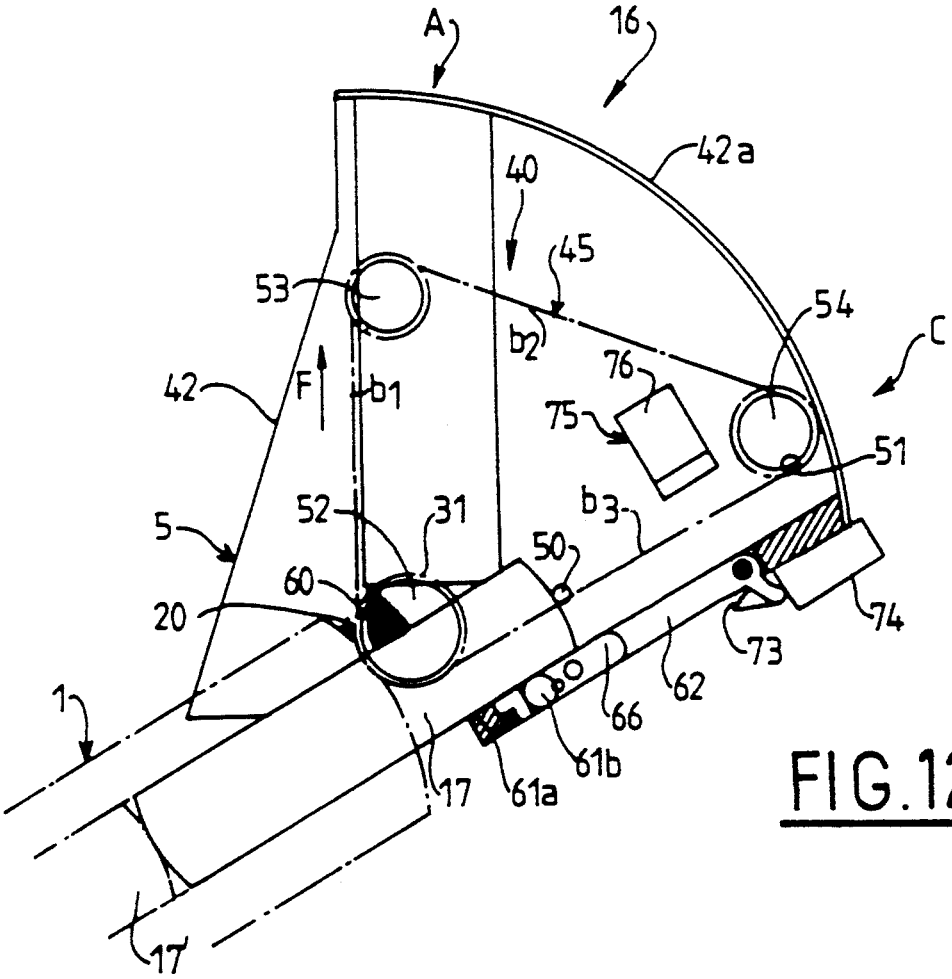

In the intermediate position, as shown in FIG. 12, the round 17 may come into abutment against an empty case 17' from the preceding shot and still present in the chamber 1. This case 17' is then pushed by the round 17 and ejected forwards from the chamber 1.

Figure 10A:
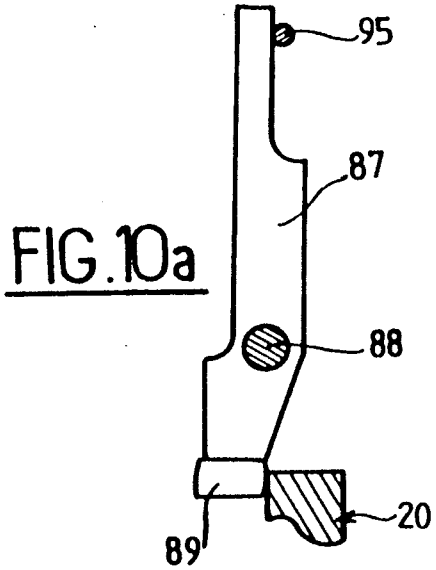
Figure 9A:
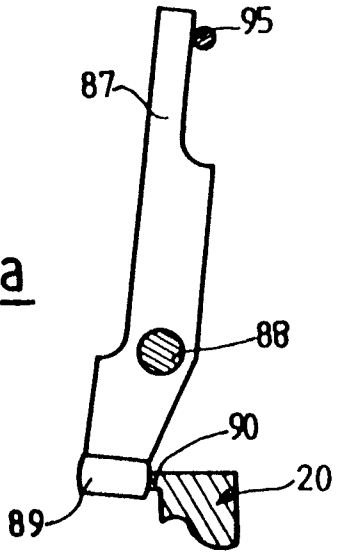

With reference to FIGS. 9 and 9*a*, the abutment 86 which was held in the raised position by the lever 87 is lowered following a change in the profile of the ramp 90 on the cam that enables the springs 93 to cause the lever 87 to pivot, thereby pushing the abutment 86. The abutment 86 then projects through the outlet opening of the chamber 1 (FIGS. 10 and 10*a*) and comes to bear against the empty case 17', thereby enabling its ejection speed to be slowed down.

During the rotation of the cam 20 that corresponds to the finger 50 being moved along the length b3 of the chain 45 for the purpose of loading the round 17 into the chamber 1, the roller 26 moves along the sector 25*a* of the groove 25 of the disk 21 in the cam 20 (mechanical link device ML1 of FIG. 1).

Once the round 17 has been loaded into the chamber 1, the lever 62 which until then had been held against the fixed wall 65 by the round 17 is released under urging from the spring 74. The lever 62 moves angularly away from the wall 65 to take up the position shown in FIG. 13, with its abutment 73 then coming to bear against the side strip 65 so as to limit the pivot angle of the lever 62. Once the empty case 17' has been ejected from the chamber 1, the abutment 86 projecting into the outlet opening of the chamber 1 moves fully down and retains the round 17 inside the chamber 1.

The cam 20 continues to rotate, driving the chamber 1 with pivoting motion towards its firing position because of the displacement of the roller 26 along sector 25*b* of the groove 25. During this stage of cam rotation, the two fingers 50 and 51 of the chain 45 pass round the sprocket 52 so as to move along the length b1 of the chain 45 and a new round 17 is put into place in the feed station A.

The round 17 loaded into the chamber 1 is fired in conventional manner by actuating the striker system 10 situated to the rear of the chamber 1 (FIG. 1). The roller 26 then moves along the sector 25*c* of the groove 25, while the chamber 1 remains in its firing position.

During the recoil motion of the gun following firing of the round 17 placed in the chamber 1, the new round 17 situated in the feed station A is held in place by the fingers 50 and 51 of the chain 45 against which the round 17 bears.

Figure 13:
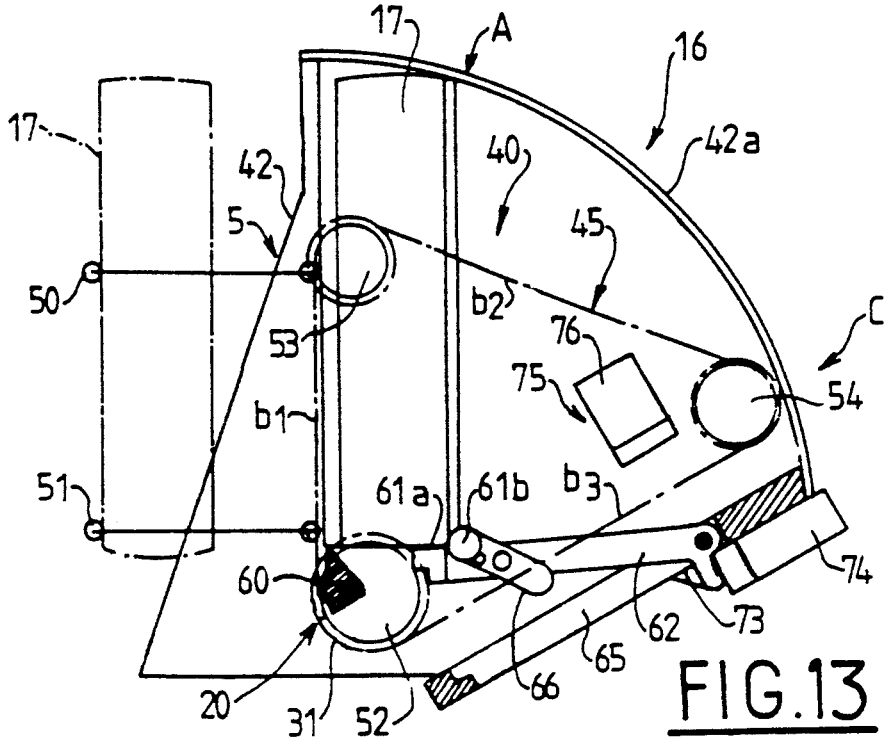

After the recoil motion of the gun, the new round 17 to be loaded in the chamber I is to be found in the position shown in FIG. 13. In this position, the front of the round 17 bears generally against the abutments 60, 61*a*, and 61*b*. As rotation of the cam 20 continues, with the roller 26 moving along the sector 25*d* of the groove 25, the chamber 1 is caused to pivot in the opposite direction towards its loading position. The finger 50 then moves onto the length b2 of the chain 45 so as to bear against the round 17 and entrain it by pivoting about the abutments 60, 61*a*, and 61*b*.

Figure 14:
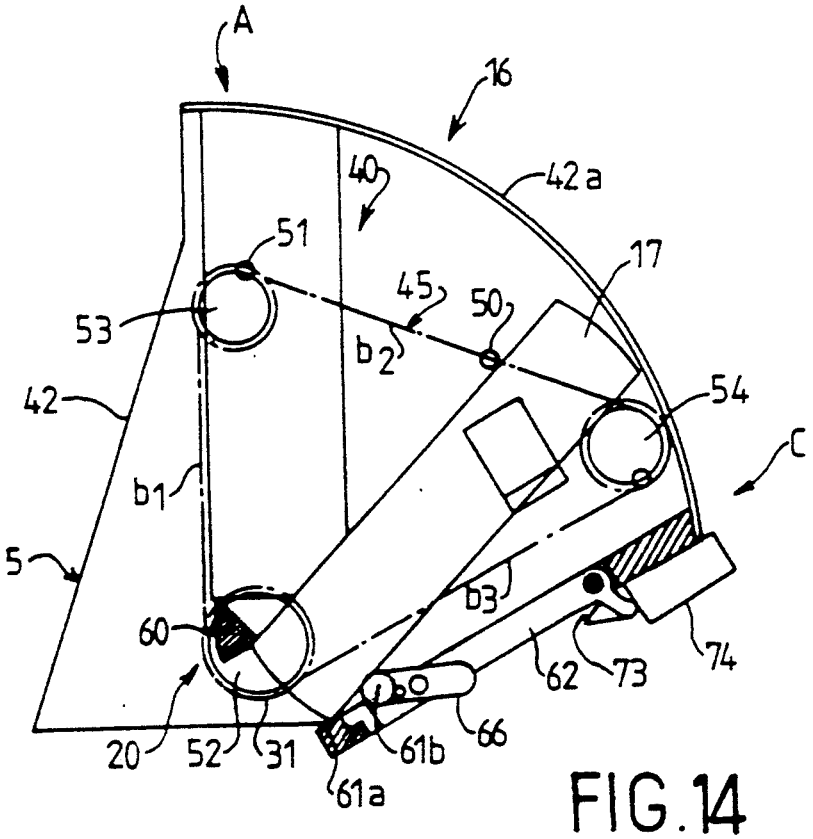

The rear portion of the round 17 bears generally against the substantially circular rim 42*a* of the plate 42 while its front portion is held by the abutments 60, 61*a*, and 61*b*. During its pivoting motion, and as shown in FIG. 14, the round 17 bears against the abutment 61*b* and the lever 66 retracts progressively by pivoting about its hinge axis 67, i.e. it tends to move closer to the lever 62 against the force exerted by the spiral spring 70, with the angle formed by these two levers 66 and 62 being progressively reduced towards 0°. Thereafter, once the lever 66 overlies the lever 62, the round 17 comes to bear against the lever 62 which in turn retracts progressively by pivoting about its hinge axis 63, i.e. it tends to move towards the fixed wall 65 against the force exerted by the spring 74 with the angle formed between the lever 62 and the wall 65 being progressively reduced to 0°. Retracting the abutment 61*a* enables the round 17 to move towards the inlet of the chamber 1. Towards the end of its pivoting motion, the round 17 pushes back the flap 76 causing it to pivot about its hinge axis 77, and thus comes to bear against the wall 65, with the flap 76 returning to its initial position under drive from the associated spring device 78. The round 17 is then in place in the loading station C and is held between the wall 65 and the flap 76, and it is to be found in the position shown in FIG. 9, prior to being loaded into the chamber 1.

In the example described above, the two fingers 50 and 51 driven by the chain 45 form means for retaining the round 17 in place in the feed station A during the recoil motion of the gun. In a variant, the finger 51 could be omitted and retaining means could be provided in the form of a fixed abutment, e.g. secured to the plate 42 and disposed parallel to the length b1 of the chain 45.

Still in the above example, it has been assumed that the cam 20 for controlling reciprocating pivoting of the chamber 1 also serves for driving the chain 45. In a variant, the rotary motion of the cam could be dissociated from the advance motion of the chain, providing these two motions are caused to operate synchronously.

Naturally, the invention is no% limited to the embodiment described above and given purely by way of example. In the context of the invention, it is possible to use means that are equivalent to those described above. In particular, the chain 45 could be replaced by a cog belt having the two drive fingers 50 and 51 fixed thereon in similar manner, or else it could be replaced by a handling bucket actuated by the rotary motion of the chamber 1. It is also possible to provide double feed by disposing two systems symmetrically about the chamber 1 and adding a mechanism for reversing the direction of rotation of the control cam 20.

We claim:

1. A system for loading a round into a pivoting chamber of a gun, comprising:

a support frame;

an oscillating mass pivotally mounted to said support frame for movement about a substantially horizontal trunnion axis;

a recoil mass mounted for movement relative to said oscillating mass; said recoil mass including a gun barrel, a sleeve at one end of said gun barrel, and a pivoting chamber mounted to said sleeve for pivoting movement between a firing position and a loading position, wherein said firing position and said loading position are angularly offset by an angle a between 0° to 90°;

a control device cooperating with said chamber for controlling pivoting of the chamber between said firing position and said loading position;

a feed device for feeding rounds, said feed device being carried by said recoil mass and comprises a feed station in which the new round is aligned on an axis substantially parallel to the trunnion axis of the gun, a loading section secured to said recoil mass and in which the new round is aligned on the axis of said chamber when the chamber is in said loading position, said feed station and said loading station being offset angularly relative to each other by an angle b which is substantially complementary to the pivot angle a of the chamber, and means for transferring the round by pivoting from the feed station to the loading station.

2. A loading system according to claim 1, in which the pivoting chamber pivots about an axis perpendicular to the trunnion axis of the gun, wherein the round in place in the feed station is in alignment on the pivot axis of the chamber, and wherein the pivot angle a of the chamber is constant and about 30°.

3. A loading system according to claim 1, wherein the means for transferring the new round from the feed station to the loading station by pivoting comprise drive means supported by a plate secured to the recoil mass of the gun, and designed to come into contact with the round.

4. A loading system according to claim 3, wherein the above-mentioned drive means are constituted by an endless chain wound over a plurality of sprockets, and at least a first finger secured to the chain and that comes into contact with the round to cause it to pivot from the feed station to the loading station.

5. A loading system according to claim 4, wherein the sprockets around which the chain is wound are at least three in number and delimit a triangle having a first side parallel to the trunnion axis of the gun and a second side aligned with the axis of the chamber when the chamber is in its loading position, the first finger carried by the chain moving parallel to three sides of the triangle.

6. A loading system according to claim 5, wherein the first finger bears laterally against the body of the round to drive the pivoting of the round as the finger moves along the first side of the triangle.

7. A loading system according to claim 5, wherein the first finger constitutes the device for loading the round by pushing against the base thereof as the finger moves along the second side of the triangle.

8. A loading system according to claim 1, including retaining means for holding a new round in place in the feed station of the feed device during the recoil motion of the gun following the firing of a round.

9. A loading system according to claim 8, wherein the retaining means includes a second finger supported by the chain and separated from the first finger by a distance that is shorter than the length of the first side of the triangle, for the purpose of maintaining the round in the feed station with the round bearing against the fingers during the recoil motion of the gun.

10. A loading system according to claim 1, wherein the transfer means are actuated by the device for controlling pivoting of the chamber.

11. A loading system according to claim 10, wherein the device for controlling pivoting of the chamber comprises a cam mounted to rotate about an axis perpendicular to the trunnion axis of the gun and connected firstly to the chamber by a first link mechanism to transform the rotary motion of the cam into reciprocating pivoting motion of the chamber, and secondly to a drive member via a second link mechanism for driving the cam in rotation.

12. A loading system according to claim 11, wherein the cam comprises a disk and in that the first link mechanism includes a groove in the bottom face of the disk and a roller mounted to rotate freely at the end of a crank to the pivot axis of the chamber, the roller being received in the groove, which groove includes four successive sectors corresponding respectively to the chamber being held in its open or loading position, to the chamber being pivoted into its firing position, to the chamber being held in its firing position, and to the chamber being pivoted in the opposite direction to return to its open or loading position again.

13. A loading system according to claim 12, wherein the reciprocating pivoting motion of the chamber is obtained by the displacement of the roller in the groove.

14. A loading system according to claim 12, wherein the disk of the cam includes a set of teeth at its peripheral surface meshing with a gear wheel constrained to rotate with the driving sprocket for the chain of the transfer means.

15. A loading system according to claim 1, wherein the feed device comprises at least one retractable abutment supported by a lever mounted to pivot between a first position and a second position by spring means, said first and second positions corresponding to a round being in the feed station and in the loading station.

16. A loading system according to claim 15, wherein the round bears against the abutment while being transferred from the feed station to the loading station, the round causing the lever to pivot towards its second position where the abutment is totally retracted.

17. A loading system according to claim 1, wherein the feed device comprises guide means in the loading station for guiding the round while it is being loaded into the chamber, said guide means being situated on either side of the round.

18. A loading system according to claim 17, wherein the guide means include a fixed wall parallel to the loading axis of the chamber, and in that the guide means include also the edge of a flap which retracts temporarily during transfer of the round from the feed station to the loading station.

19. A loading station according to claim 1, wherein the front end of the chamber includes a lateral projection which closes the inlet to the barrel when the chamber is in its loading position.

20. A loading system according to claim 1, including a locking device for locking a round loaded inside the chamber, said locking device comprising a retractable abutment actuated by a pivoting lever which bears against a ramp of the control cam.

* * * * *

UNITED STATES PATENT AND TRADEMARK OFFICE

CERTIFICATE OF CORRECTION

PATENT NO. : 5,333,530

DATED : August 2, 1994

INVENTOR(S) : Georges Simon et al.

It is certified that error appears in the above-identified patent and that said Letters Patent is hereby corrected as shown below:

Column 2, line 14, "The" should be -- the --.

Column 3, line 53, "The" should be -- the --.

Column 4, line 37, "shade" should be -- shape --.

Column 5, line 31, "toiler" should be -- roller --.

Column 5, line 33, "toiler" should be -- roller --.

Column 8, line 66, "I" should be -- 1 --.

Column 9, line 48, "no%" should be -- not --.

Column 10, line 14, "section" should be -- station --.

Signed and Sealed this

Twenty-seventh Day of September, 1994

*Attest:*

Bruce Lehman

BRUCE LEHMAN

*Attesting Officer*

*Commissioner of Patents and Trademarks*